US009984658B2

(12) United States Patent
Bonnier et al.

(10) Patent No.: US 9,984,658 B2
(45) Date of Patent: May 29, 2018

(54) DISPLAYS WITH IMPROVED COLOR ACCESSIBILITY

(71) Applicant: Apple Inc., Cupertino, CA (US)

(72) Inventors: Nicolas P. Bonnier, Campbell, CA (US); Jiaying Wu, Santa Clara, CA (US); Can Jin, San Jose, CA (US); Roy J. E. M. Raymann, Campbell, CA (US)

(73) Assignee: Apple Inc., Cupertino, CA (US)

( * ) Notice: Subject to any disclaimer, the term of this patent is extended or adjusted under 35 U.S.C. 154(b) by 0 days. days.

(21) Appl. No.: 15/244,940

(22) Filed: Aug. 23, 2016

(65) Prior Publication Data

US 2017/0301310 A1 Oct. 19, 2017

Related U.S. Application Data

(60) Provisional application No. 62/324,511, filed on Apr. 19, 2016.

(51) Int. Cl.
*G09G 5/04* (2006.01)
*G09G 5/06* (2006.01)

(52) U.S. Cl.
CPC ..... *G09G 5/04* (2013.01); *G09G 5/06* (2013.01); *G09G 2320/0613* (2013.01); (Continued)

(58) Field of Classification Search
CPC ..... G09G 5/04; G09G 5/06; G09G 2320/06; H04N 1/60
See application file for complete search history.

(56) References Cited

U.S. PATENT DOCUMENTS

2012/0147163 A1 6/2012 Kaminsky
2013/0027420 A1 1/2013 Felt
(Continued)

FOREIGN PATENT DOCUMENTS

EP 2886039 6/2015

OTHER PUBLICATIONS

"Vischeck:Home" Vischeck. Accessed via web @ https://web.archive.org/web/20020602201210/http://vischeck.com:80/, Jun. 2, 2002, https://web.archive.org/web/20020806172450/http://www.vischeck.com/daltonize/runDaltonize.php, Aug. 6, 2002, https://web.archive.org/web/20020607224213/http://vischeck.com:80/daltonize/, Jun. 7, 2002, https://web.archive.org/web.*
(Continued)

*Primary Examiner* — Antonio A Caschera
(74) *Attorney, Agent, or Firm* — Treyz Law Group, P.C.; Kendall W. Abbasi

(57) ABSTRACT

An electronic device may include a display and control circuitry that operates the display. The control circuitry may be configured to daltonize input images to produce daltonized output images that allow a user with color vision deficiency to see a range of detail that the user would otherwise miss. The daltonization algorithm that the control circuitry applies to input images may be specific to the type of color vision deficiency that the user has. The daltonization strength that the control circuitry applies to the image or portions of the image may vary based on image content. For example, natural images may be daltonized with a lower daltonization strength than web browsing content, which ensures that memory colors such as blue sky and green grass do not appear unnatural to the user while still allowing important details such as hyperlinks and highlighted text to be distinguishable.

20 Claims, 10 Drawing Sheets

(52) U.S. Cl.
CPC . *G09G 2320/0686* (2013.01); *G09G 2320/08* (2013.01); *G09G 2340/06* (2013.01); *G09G 2340/14* (2013.01); *G09G 2354/00* (2013.01)

(56) References Cited

U.S. PATENT DOCUMENTS

| | | | |
|---|---|---|---|
| 2013/0342555 | A1 | 12/2013 | Braham et al. |
| 2016/0217723 | A1 | 7/2016 | Kim et al. |

OTHER PUBLICATIONS

"Intelligent modification of the daltonization process of digitized paintings" Anagnostopoulos et al. ICVS 2007. 2007. Applied Computer Science Group. http://biecoll.ub.uni-bielefeld.de/volltexte/2007/52/pdf/ICVS2007-6.pdf.*

* cited by examiner $$\overbrace{\begin{bmatrix} L \\ M \\ S \end{bmatrix}}^{76} + \overbrace{\begin{bmatrix} O & O & O \\ \beta & O & O \\ \alpha & O & O \end{bmatrix}}^{78} \overbrace{\begin{bmatrix} E \\ O \\ O \end{bmatrix}}^{80} = \overbrace{\begin{bmatrix} L \\ M + \beta E \\ S + \alpha E \end{bmatrix}}^{82}$$

*FIG. 7*

$$\overbrace{\begin{bmatrix} L \\ M \\ S \end{bmatrix}}^{76} + \overbrace{\begin{bmatrix} O & \beta & O \\ O & O & O \\ O & \alpha & O \end{bmatrix}}^{78} \overbrace{\begin{bmatrix} O \\ E \\ O \end{bmatrix}}^{80} = \overbrace{\begin{bmatrix} L + \beta E \\ M \\ S + \alpha E \end{bmatrix}}^{82}$$

*FIG. 8*

$$\overbrace{\begin{bmatrix} L \\ M \\ S \end{bmatrix}}^{76} + \overbrace{\begin{bmatrix} O & O & \alpha \\ O & O & \beta \\ O & O & O \end{bmatrix}}^{78} \overbrace{\begin{bmatrix} O \\ O \\ E \end{bmatrix}}^{80} = \overbrace{\begin{bmatrix} L + \alpha E \\ M + \beta E \\ S \end{bmatrix}}^{82}$$

*FIG. 9*

DISPLAYS WITH IMPROVED COLOR ACCESSIBILITY

This application claims the benefit of provisional patent application No. 62/324,511, filed Apr. 19, 2016, which is hereby incorporated by reference herein in its entirety.

BACKGROUND

This relates generally to displays and, more particularly, to electronic devices with displays.

Electronic devices often include displays. For example, cellular telephones and portable computers often include displays for presenting information to a user.

Some users have a color vision deficiency that makes it difficult to distinguish between different colors on the display. Users with color vision deficiencies may miss a significant amount of visual detail in the images on a display screen, ranging from textual information to photographs and videos.

Daltonization is a process through which colors on a display are adjusted to allow users with color vision deficiencies to distinguish a range of detail they would otherwise miss. Daltonization is sometimes offered by applications such as websites, web browsers, or desktop applications. These applications adjust the display colors in a targeted display area to make the display content in that area more accessible to the user. These daltonization applications typically apply a single static daltonization algorithm with uniform daltonization strength to the entire targeted display area.

Conventional daltonization algorithms can impose harsh color changes on display content. Since the same daltonization algorithm is applied across the entire targeted display area, display regions where little or no daltonization is desired receive the same color adjustment algorithm as display regions where strong daltonization is desired. This can lead to unsightly results for the user. For example, changing the appearance of memory colors associated with common features such as green grass, blue sky, and skin tones may look completely unnatural to a user with color vision deficiency. Conventional daltonization algorithms are therefore unable to effectively daltonize images without imposing harsh color transformations on areas of the display where little or no daltonization is needed.

It would therefore be desirable to be able to provide displays with improved color accessibility.

SUMMARY

An electronic device may include a display and control circuitry that operates the display. The control circuitry may be configured to daltonize input images to produce daltonized output images that allow a user with color vision deficiency to see a range of detail that the user would otherwise miss.

The daltonization algorithm that the control circuitry applies to input images may be specific to the type of color vision deficiency that the user has. The control circuitry may determine color vision deficiency type by prompting the user to take a test or to select his or her type of color vision deficiency from an on-screen menu of options.

The daltonization strength that the control circuitry applies to the image or portions of the image may vary based on image content. For example, natural images in one portion of an image may be daltonized with a lower daltonization strength than web browsing content in another portion of the image, which ensures that memory colors such as blue sky and green grass do not appear unnatural to the user while still allowing important details such as hyperlinks and highlighted text to be distinguishable.

Daltonization strength may be varied using a three-dimensional look-up table that allows color loss associated with the color vision deficiency to be non-linearly mapped to fully functioning color channels. For example, saturated input colors in the three-dimensional look-up table may be mapped to daltonized output colors with a different daltonization strength than neutral input colors in the three-dimensional look-up table. The three-dimensional look-up table may be stored in storage in the electronic device and may be accessed by the control circuitry when it is desired to present daltonized images on the display.

If desired, the electronic device may store multiple three-dimensional look-up tables to allow for different types of non-linear mapping of color loss. For example, one three-dimensional look-up table may be used to daltonize natural images (e.g., photographs or other images with memory colors such as blue sky, green grass, skin tones, etc.). Another three-dimensional look-up table may be used to daltonize web browsing content or graphic art.

BRIEF DESCRIPTION OF THE DRAWINGS

FIG. 7 is a matrix equation showing how an image is converted to a daltonized image for a user with a weak or missing L-cone in accordance with an embodiment.

FIG. 8 is a matrix equation showing how an image is converted to a daltonized image for a user with a weak or missing M-cone in accordance with an embodiment.

FIG. 9 is a matrix equation showing how an image is converted to a daltonized image for a user with a weak or missing S-cone in accordance with an embodiment.

DETAILED DESCRIPTION

Figure 1:
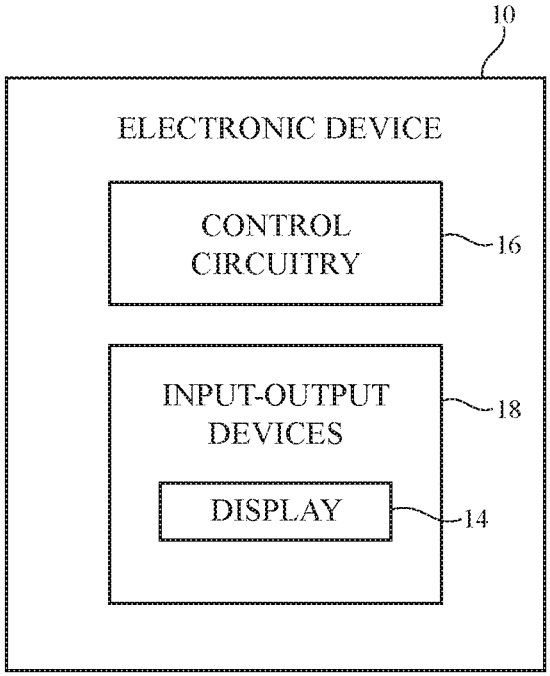
FIG. 1 is a schematic diagram of an illustrative electronic device with a display in accordance with an embodiment.

An illustrative electronic device of the type that may be provided with a display is shown in FIG. 1. Device 10 of FIG. 1 may be a computing device such as a laptop computer, a computer monitor containing an embedded computer, a tablet computer, a cellular telephone, a media player, or other handheld or portable electronic device, a smaller device such as a wrist-watch device (e.g., a watch with a wrist strap), a pendant device, a device embedded in eyeglasses or other equipment worn on a user's head, or other wearable or miniature device, a television, a computer display that does not contain an embedded computer, a gaming device, a navigation device, an embedded system such as a system in which electronic equipment with a display is mounted in a kiosk or automobile, equipment that implements the functionality of two or more of these devices, or other electronic equipment.

As shown in FIG. 1, electronic device 10 may have control circuitry 16. Control circuitry 16 may include storage and processing circuitry for supporting the operation of device 10. The storage and processing circuitry may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in control circuitry 16 may be used to control the operation of device 10. The processing circuitry may be based on one or more microprocessors, microcontrollers, digital signal processors, baseband processors, power management units, audio chips, application specific integrated circuits, etc.

Input-output circuitry in device 10 such as input-output devices 18 may be used to allow data to be supplied to device 10 and to allow data to be provided from device 10 to external devices. Input-output devices 18 may include buttons, joysticks, scrolling wheels, touch pads, key pads, keyboards, microphones, speakers, tone generators, vibrators, cameras, sensors, light-emitting diodes and other status indicators, data ports, etc. A user can control the operation of device 10 by supplying commands through input-output devices 18 and may receive status information and other output from device 10 using the output resources of input-output devices 18.

Input-output devices 18 may include one or more displays such as display 14. Display 14 may be a touch screen display that includes a touch sensor for gathering touch input from a user or display 14 may be insensitive to touch. A touch sensor for display 14 may be based on an array of capacitive touch sensor electrodes, acoustic touch sensor structures, resistive touch components, force-based touch sensor structures, a light-based touch sensor, or other suitable touch sensor arrangements. Display 14 and other components in device 10 may include thin-film circuitry.

Control circuitry 16 may be used to run software on device 10 such as operating system code and applications. During operation of device 10, the software running on control circuitry 16 may display images on display 14. Display 14 may be an organic light-emitting diode display, a liquid crystal display, or any other suitable type of display.

Control circuitry 16 may be used to adjust display colors to make the content on display 14 more accessible to users with color vision deficiencies. This may include, for example, daltonizing input images to produce daltonized output images. Daltonization is a process in which the colors in images are adjusted to allow users with color vision deficiencies to observe a range of detail in the images that they would otherwise be unable to see. Control circuitry 16 may transform input images to daltonized output images based on the type of color vision deficiency that a user has. For example, for a user with a missing or malfunctioning M-cone that has trouble distinguishing red from green, control circuitry 16 may daltonize images by rotating green hues towards blue hues and rotating red hues towards yellow hues.

Control circuitry 16 may apply different daltonization algorithms to images depending on the type of color vision deficiency the user has. Control circuitry 16 may determine the type of color deficiency that a user has based on input from the user. For example, a user may manually select his or her specific type of color deficiency from a menu of different types of color deficiencies on display 14. As another example, display 14 may present one or more daltonized images that the user can choose from in order to determine which type of daltonization algorithm works best for the user. If desired, a user may choose to take a color vision deficiency test on device 10 whereby a series of images containing numbers or letters are presented on display 14 and the user inputs what they observe in the images. One illustrative example of a color vision test is a test that uses Ishihara plates to determine whether a person has a color deficiency, what kind of color deficiency the person has, and how strong the color deficiency is. Other color vision tests may be used, if desired.

Control circuitry 16 may daltonize images using a one-dimensional look-up table (1D LUT), a 1D LUT and a three-by-three matrix, a three-dimensional look-up table (3D LUT), or other suitable color mapping operators. For example, daltonization may be performed using a 3D LUT that is accessed from storage in control circuitry 16. In another suitable embodiment, a 3D LUT or other color mapping operator may be custom built on-the-fly for a user after the user takes a color vision test on device 10. Look-up tables and other color mapping algorithms may be stored in electronic device 10 (e.g., in storage that forms part of control circuitry 16).

After determining the type of color vision deficiency that a user has, control circuitry 16 may daltonize images based on the type of color deficiency (e.g., by mapping input pixel values to daltonized output pixel values using a 3D LUT stored in device 10).

In addition to being color-deficiency-specific, control circuitry 16 may daltonize images using an algorithm that is also content-specific. For example, control circuitry 16 may apply different "strengths" of daltonization for different types of display content. Display content that needs little or no daltonization (e.g., memory colors, photographs, certain saturated colors, etc.) may be color-adjusted only slightly or may not be color-adjusted at all. Display content that needs strong daltonization (e.g., textual information, neutral colors, etc.) may be more aggressively color-adjusted to allow this content to be distinguishable to the user. Control circuitry 16 may vary daltonization strength from pixel to pixel, from display region to display region, and/or from image to image. By using different daltonization strengths, information on display 14 may be more accessible to the user without imposing harsh color adjustments on the entire image.

Figure 2:
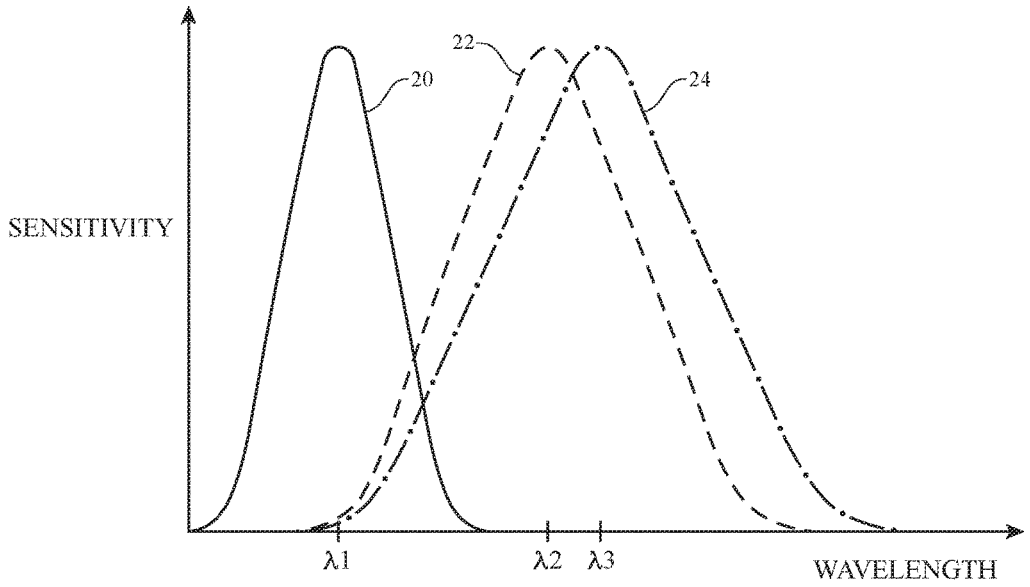
FIG. 2 is a graph illustrating the responsivity spectra of human cone cells with full color perception in accordance with an embodiment.

FIG. 2 is a graph showing the responsivity spectra of human cone cells with full color perception. Curve 20 represents the responsivity of the S-cone (sometimes referred to as the short cone) having a peak sensitivity at $\lambda 1$. Curve 22 represents the responsivity of the M-cone (sometimes referred to as the medium cone) having a peak sensitivity at $\lambda 2$. Curve 24 represents the responsivity of the L-cone (sometimes referred to as the long cone) having a peak sensitivity at $\lambda 3$. Peak wavelength $\lambda 3$ may range between about 420 nm and 440 nm. Peak wavelength $\lambda 2$ may range between about 534 nm and 545 nm. Peak wavelength λ3 may range between about 564 nm and 580 nm.

There are various types of color vision deficiency. Monochromatism occurs when an individual only has one or no type of cone. Dichromatism occurs when an individual only has two different cone types and the third type of cone is missing. Types of dichromatism include protanopia in which the L-cone is missing, deuteranopia in which the M-cone is missing, and tritanopia in which the S-cone is missing. Anomalous trichromatism occurs when an individual has all three types of cones but with shifted peaks of sensitivity for one or more cones. Types of anomalous trichromatism include protanomaly in which the peak sensitivity of the L-cone is shifted (e.g., shifted relative to peak wavelength λ3 of normal L-cone sensitivity curve 24), deuteranomaly in which the peak sensitivity of the M-cone is shifted (e.g., shifted relative to peak wavelength λ2 of normal M-cone sensitivity curve 22), and tritanomaly in which the peak sensitivity of the S-cone is shifted (e.g., shifted relative to peak wavelength λ1 of normal S-cone sensitivity curve 20).

Figure 3:
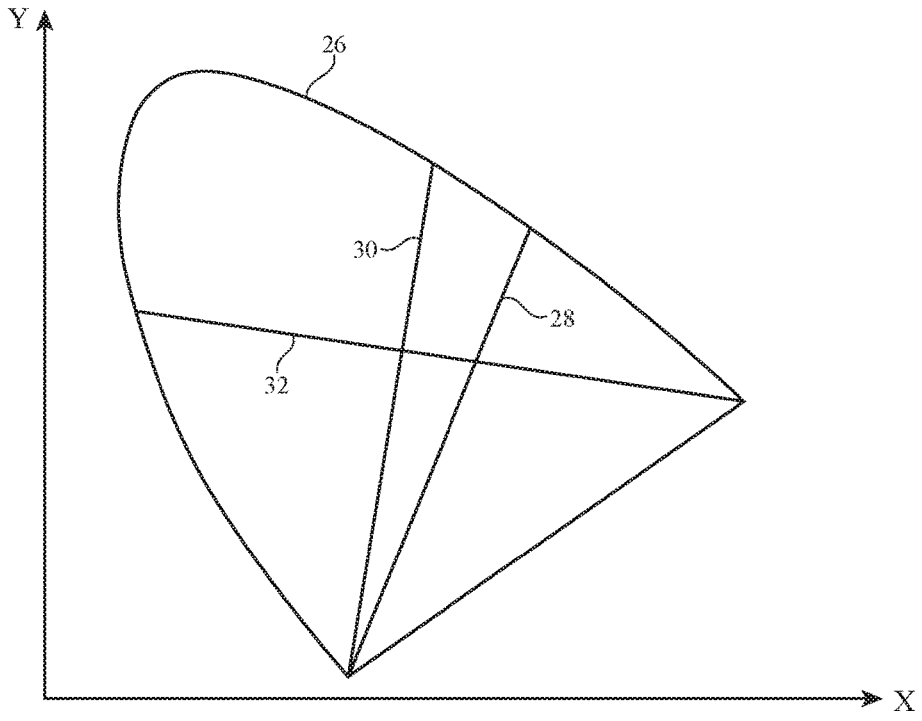
FIG. 3 is a chromaticity diagram illustrating different types of color vision deficiency in accordance with an embodiment.

FIG. 3 is a chromaticity diagram illustrating how users with color vision deficiencies may perceive a reduced color space relative to users without color vision deficiencies. The chromaticity diagram of FIG. 3 illustrates a two-dimensional projection of a three-dimensional color space (sometimes referred to as the 1931 CIE chromaticity diagram). A color in the visible spectrum may be represented by chromaticity values x and y. The chromaticity values may be computed by transforming, for example, three color intensities (e.g., intensities of colored light emitted by a display) such as intensities of red, green, and blue light into three tristimulus values X, Y, and Z and normalizing the first two tristimulus values X and Y (e.g., by computing $x=X/(X+Y+Z)$ and $y=Y/(X+Y+Z)$ to obtain normalized x and y values). Transforming color intensities into tristimulus values may be performed using transformations defined by the International Commission on Illumination (CIE) or using any other suitable color transformation for computing tristimulus values.

Any color generated by a display may therefore be represented by a point (e.g., by chromaticity values x and y) on a chromaticity diagram such as the diagram shown in FIG. 3. Region 26 of FIG. 3 represents a three-dimensional volume of colors that are visible to humans with full color perception. The colors that may be perceived by humans with color vision deficiencies are contained within region 26. For example, users with deuteranopia may only perceive colors within a two-dimensional space intersecting with line 28; users with protanopia may only perceive colors within a two-dimensional space intersecting with line 30; and users with tritanopia may only perceive colors within a two-dimensional space intersecting with line 32. Users with anomalous trichromatism may perceive a three-dimensional volume of colors that is smaller than the volume of region 26.

Figure 4:
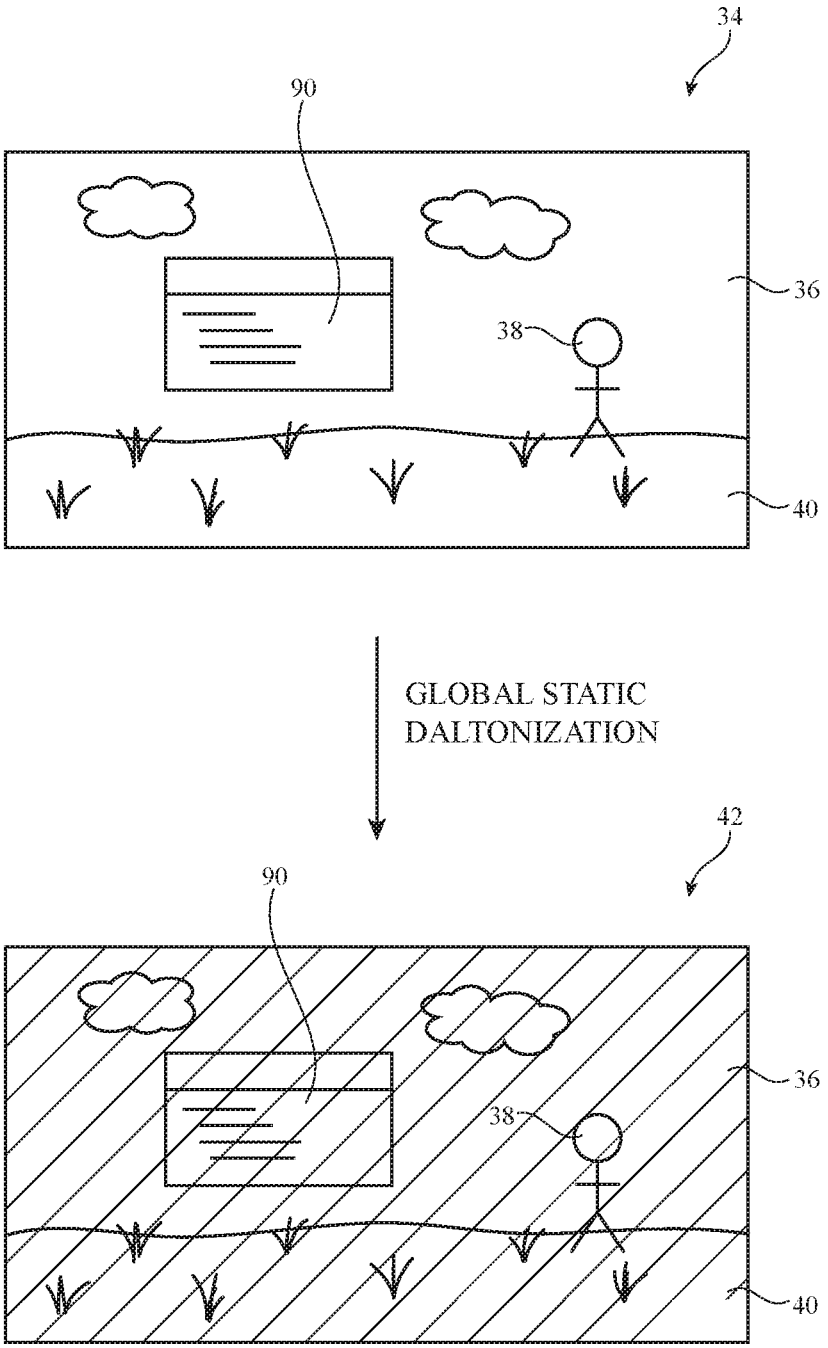
(PRIOR ART) FIG. 4
FIG. 4 is a diagram illustrating the effects of a conventional daltonization method.

FIG. 4 is a diagram illustrating a conventional method of daltonizing an input image 34 to produce a daltonized output image 42. Input image 34 includes text 90 and a photograph with common features such as blue sky 36, green grass 40, and skin tones 38 in the photograph. In conventional applications, daltonization is performed by simulating how a color vision deficient user would see original image 34, calculating the color loss of the simulated image, and linearly mapping the color loss to other color components (e.g., color components that the color vision deficient user is able to see).

This same algorithm is applied globally to the entire image 34 to produce daltonized image 42. In daltonized image 42, the same strength of daltonization has been applied across the image, causing a color shift in text 90 and the objects in the photograph such as blue sky 36, green grass 40, and skin tones 38. The adjustment of colors in image 42 allows a user to see details in text 90 and in the photograph that he or she might have otherwise missed. However, some regions of image 42 may look unnatural to the user as a result of the uniform color adjustment. For example, the colors of sky 36, grass 40, and skin 38 may be memory colors that the user is accustomed to seeing with the colors of original image 34. When daltonization is applied uniformly across image 34, memory colors 36, 38, and 40 are adjusted just as aggressively as the neutral colors of text 90. The conventional method of applying the same daltonization algorithm to the entire image regardless of the image content may therefore lead to unattractive results that look unnatural to the user.

Figure 5:
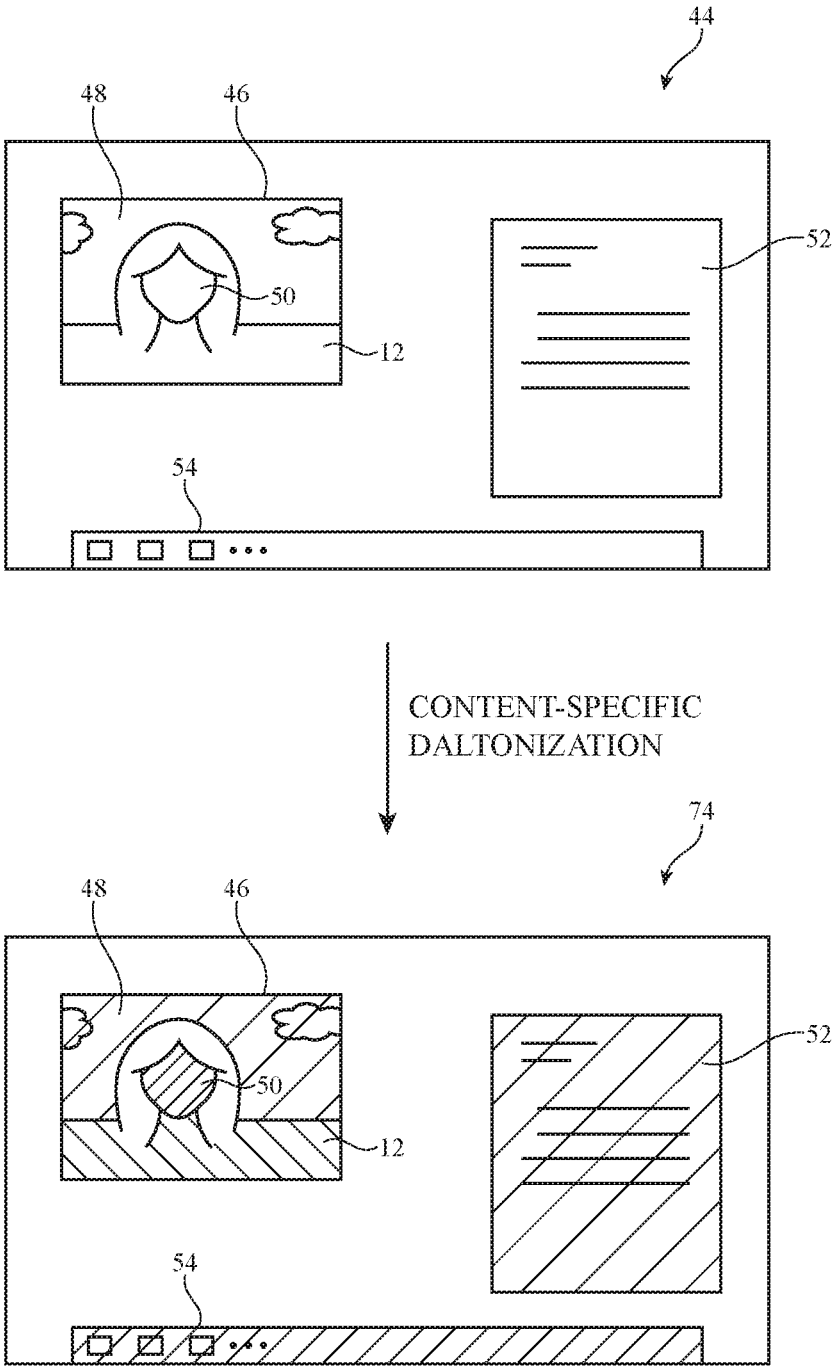
FIG. 5 is a diagram illustrating how different strengths of daltonization may be applied for different display regions in accordance with an embodiment.

FIG. 5 is a diagram illustrating how control circuitry 16 of FIG. 1 uses a content-specific daltonization method to overcome the shortcomings of the conventional method of FIG. 4. As shown in FIG. 5, original image 44 includes various types of content such as text information 52 (e.g., part of a word processing application, a web browsing application, an e-mail application, etc.), photography 46 (e.g., natural images including common memory colors such as blue sky 48, green grass 12, and skin tones 50), and user interface elements 54 (e.g., icons, virtual buttons, etc.).

Control circuitry 16 may apply a content-specific daltonization algorithm that applies a stronger color adjustment to some regions of image 44 and a weaker color adjustment (or no color adjustment at all) to other regions of image 44. The variation in daltonization strength may be based on the type of content (e.g., photograph, graphic art, text information, video, web page, etc.), the application presenting the content (e.g., a photo viewing application, a web browsing application, a word processing application, an e-mail application, etc.), color characteristics of the content (e.g., saturation level, memory color, neutral color, etc.), an amount of color loss associated with a simulated color deficient version of the original image, or other suitable characteristics of the content in image 44. These characteristics may be considered on a per-pixel basis, a per-region basis, or a per-image basis. Similarly, the strength of daltonization may vary on a per-pixel basis, a per-region basis, or a per-image basis. If desired, the strength of daltonization may be adjusted based on user preferences. For example, if a user prefers that user interface elements 54 remain unchanged or that certain memory colors are only slightly adjusted, the user can input these preferences to device 10 and control circuitry 16 can adjust the daltonization strength accordingly.

Control circuitry 16 may apply this type of content-specific daltonization to original image 44 to produce daltonized image 74. Daltonized image 74 may have some areas such as text information 52 that have been daltonized more aggressively than other areas such as photograph 46. In other words, the color difference between text information 52 of original image 44 and daltonized image 74 may be greater than the color difference between photograph 46 of original image 44 and daltonized image 74, if desired. For example, blue sky 48, skin tones 50, green grass 12, and other memory colors in original image 44 may be only slightly adjusted or may not be adjusted at all in daltonized image 74, whereas the colors of text area 52 may be sufficiently adjusted to allow important details such as hyperlinks, highlighted text, and other information to become distinguishable to the user. These examples are merely illustrative, however. If desired, memory colors may be daltonized with a relatively high daltonization strength and text information may be daltonized with a relatively low daltonization strength. In general, daltonization strength may be varied based on content in any suitable fashion.

Control circuitry 16 may perform content-specific daltonization by simulating a color deficient version of original image 44 (e.g., simulating a version of image 44 as it would appear to a color vision deficient user), determining the color loss associated with the simulated image, and mapping all or a portion of the color loss to other color components (e.g., color components that are detected by the color vision deficient user). The mapping of the color loss may be non-linear or linear. The strength of daltonization is adjusted by adjusting the amount of color loss that is mapped to the other color components. For example, although a color vision deficient user may observe green grass 12 of original image 44 with significant color loss, control circuitry 16 may map only a portion of the color loss to other color channels in daltonized image 74, resulting in a relatively weak daltonization for green grass 12. In contrast, control circuitry 16 may map all of the color loss associated with text area 52 to other color channels in daltonized image 74, resulting in a relatively strong daltonization for text area 52 (as an example).

Figure 6:
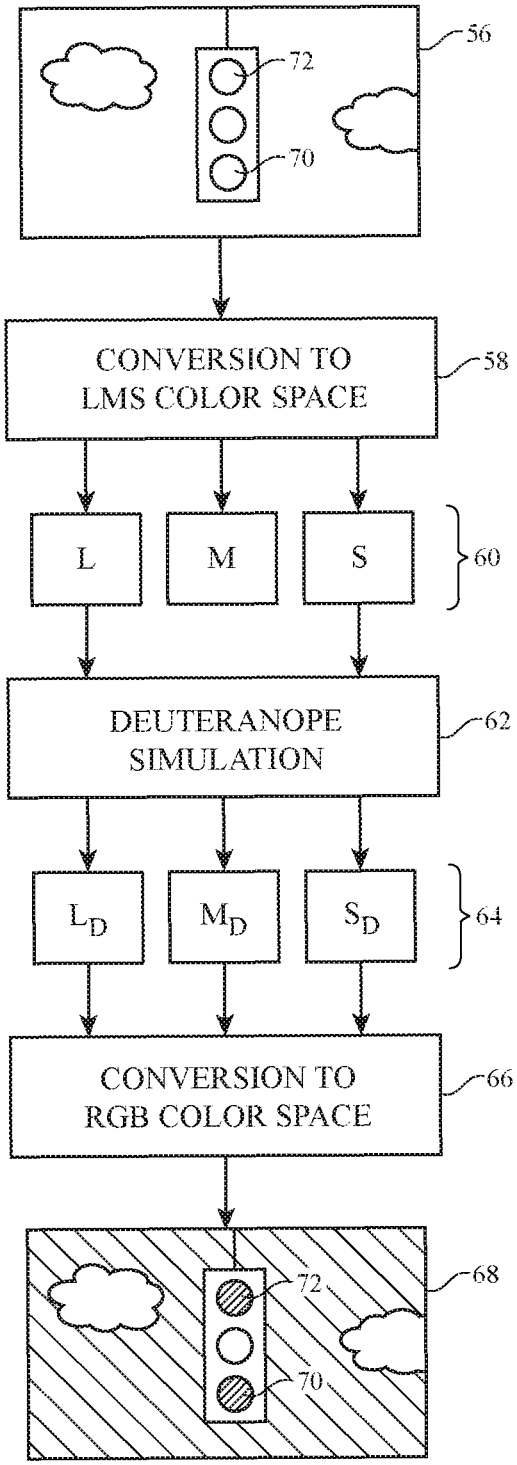
FIG. 6 is a diagram illustrating how control circuitry simulates how an image appears to a color vision deficient user in accordance with an embodiment.

FIG. 6 is a diagram illustrating how control circuitry 16 may simulate how an image appears to a color vision deficient user. The example of FIG. 6 illustrates color loss simulation for a user with deuteranopia (missing M-cone). However, it should be understood that similar simulation techniques may be used for other types of color vision deficiencies.

To determine how an input image such as input image 56 appears to a color vision deficient user, control circuitry 16 may convert the pixel values associated with image 56 from the color space of display 14 to LMS color space (step 58). The color space of display 14 may, for example, be a red-green-blue color space in which image 56 is made up of red, green, and blue digital pixel values (e.g., ranging from 0 to 255 in displays with 8-bits per color channel). Converting the RGB values of input image 56 to LMS values 60 may be achieved using any suitable known conversion matrix.

Following conversion to LMS color space, control circuitry 16 may use a known color transformation matrix specific to the type of color vision deficiency (e.g., deuteranopia) to convert LMS values 60 of original image 56 to adjusted LMS values 64 that represent how a user with deuteranopia would see original image 56 (step 62). The color transformation algorithm applied in step 62 will depend on the type of color vision deficiency.

The example of FIG. 6 in which simulation is achieved by converting input image 56 to LMS color space is merely illustrative. If desired, simulation of color deficient image 68 may be achieved in RGB color space or any other suitable color space (e.g., CIELAB color space, CIELUV color space, CIEXYZ color space, or other suitable color space).

Control circuitry 16 may then convert adjusted LMS values 64 from LMS color space back to RGB color space (step 66) to produce simulated image 68. In image 68 simulated for deuteranopia, certain colors such as green colors 70 and red colors 72 may be indistinguishable from one another.

Control circuitry 16 may determine an amount of color loss associated with simulated image 68 by determining the difference between input image 56 and simulated image 68. In images simulated for deuteranopia, for example, the pixel values for blue pixels associated with input image 56 may be the same as or close to the simulated pixel values of simulated image 68 (i.e., the blue channel may have little or no color loss). The pixel values for green pixels in simulated image 68, on the other hand, may be significantly different from the pixel values for green pixels in original image 56. After determining the color loss associated with simulated image 68, control circuitry 16 may map all or a portion of the color loss to one or more of the color channels that are not affected by the color vision deficiency.

The example of FIG. 6 in which color loss is calculated in RGB color space (e.g., by determining the difference between the RGB values of original image 56 and the RGB values of simulated image 68) is merely illustrative. If desired, color loss may be determined in LMS color space (e.g., by determining the difference between original LMS values 60 and simulated LMS values 64) or any other suitable color space.

In one illustrative arrangement, control circuitry 16 may determine the color loss in LMS color space and may map the color loss to other color channels also in LMS color space. For example, if the difference between LMS values 60 and simulated LMS values 64 is zero for the L and S channels and some non-zero value for the M channel, control circuitry 16 may map all or a fraction of the non-zero value to the L and/or S channels before converting back to RGB color space to produce a daltonized image. As used herein, "color loss" may refer to the difference between an image as would appear to a user with full color perception and the image as it would appear to a user with a color vision deficiency. Color loss may be expressed in any desired color space.

FIGS. 7, 8, and 9 show matrix equations that may be used to map all or a fraction of color loss to other color channels to produce a daltonized image. The example of FIG. 7 shows how to map input LMS values in matrix 76 to output LMS values in matrix 82 when the color loss is associated with the L-cone (e.g., for users with protanopia or protanomaly). The example of FIG. 8 shows how to map input LMS values in matrix 76 to output LMS values in matrix 82 when the color loss is associated with the M-cone (e.g., for users with deuteranopia or deuteranomaly). The example of FIG. 9 shows how to map input LMS values in matrix 76 to output LMS values in matrix 82 when the color loss is associated with the S-cone (e.g., for users with tritanopia or tritanomaly).

Matrix 80 represents the color loss in LMS color space for a color vision deficient user (e.g., the difference between the original image and the image as seen by the color vision deficient user). Matrix 78 represents a daltonization strength matrix that determines how much of the color loss in matrix 80 is mapped to other color channels. By varying the daltonization strength factors $\alpha$ and $\beta$ within daltonization strength matrix 78, control circuitry 16 can control the amount of color shift between original image 44 and daltonized image 74 (FIG. 5). Daltonization strength factors $\alpha$ and $\beta$ may be values ranging from −1 to 1 (e.g., $\alpha$ and/or $\beta$ may be equal to 0.1, 0.5, −0.1, −0.5, etc.). If no daltonization is desired, $\alpha$ and $\beta$ may both be equal to zero. The further from zero $\alpha$ and $\beta$ are, the stronger the daltonization will be in the corresponding output values 82. Whether $\alpha$ and $\beta$ are positive or negative will determine the direction that the colors are rotated (e.g., towards or away from green, towards or away from red, towards or away from blue, etc.). Because daltonization strength factors $\alpha$ and $\beta$ determine the amount by which the display color space is transformed (e.g., rotated), factors α and β may sometimes be referred to as transformation parameters.

As shown in FIG. 7, users with a missing or malfunctioning L-cone will experience non-zero color loss E in the L channel but little or no color loss in the M and S channels. Control circuitry 16 may add a desired amount of the color loss E to the functioning M and S channels by multiplying color loss matrix 80 with daltonization strength matrix 78 and adding the result to original LMS values 76. As shown in output matrix 82, this adds nothing to the L channel but adds (β*E) to the M channel and (α*E) to the S channel.

As shown in FIG. 8, users with a missing or malfunctioning M-cone will experience non-zero color loss E in the M channel but little or no color loss in the L and S channels. Control circuitry 16 may add a desired amount of the color loss E to the functioning L and S channels by multiplying color loss matrix 80 with daltonization strength matrix 78 and adding the result to original LMS values 76. As shown in output matrix 82, this adds nothing to the M channel but adds (β*E) to the L channel and (α*E) to the S channel.

As shown in FIG. 9, users with a missing or malfunctioning S-cone will experience non-zero color loss E in the S channel but little or no color loss in the L and M channels. Control circuitry 16 may add a desired amount of the color loss E to the functioning L and M channels by multiplying color loss matrix 80 with daltonization strength matrix 78 and adding the result to original LMS values 76. As shown in output matrix 82, this adds nothing to the S channel but adds (α*E) to the L channel and (β*E) to the M channel.

If desired, one or both of α and β may be equal to zero. For example, in daltonization strength matrix 78 of FIG. 7, β may be equal to zero so that the desired portion of color loss E is only mapped to the S channel. In some scenarios, mapping color loss from the L or M channels to the S channel may be advantageous because the spectral sensitivity of the S-cone is isolated from that of the other cones (see FIG. 2). This is, however, merely illustrative. In general, all or a portion of the color loss E may be mapped to any one or more of the functioning color channels.

Control circuitry 16 may adjust the daltonization strength by adjusting the value of α and β. As described above in connection with FIG. 5, control circuitry 16 may adjust daltonization strength based on the type of content (e.g., photograph, graphic art, text information, video, web page, etc.), the application presenting the content (e.g., a photo viewing application, a web browsing application, a word processing application, an e-mail application, etc.), color characteristics of the content (e.g., saturation level, memory color, neutral color, etc.), an amount of color loss associated with a simulated color deficient version of the original image, or other suitable characteristics of the content in the image. These characteristics may be considered on a per-pixel basis, a per-region basis, or a per-image basis. Similarly, the strength of daltonization may vary on a per-pixel basis, a per-region basis, or a per-image basis. If desired, the strength of daltonization may be adjusted based on user preferences.

If desired, a desired daltonization strength may be determined in manufacturing, and α and β may be fixed at the desired daltonization strength. A matrix for each type of color deficiency (e.g., matrices 78 of FIGS. 7, 8, and 9) containing the fixed daltonization strength factors α and β may be stored in device 10 and applied when daltonization is desired. In another suitable embodiment, daltonization strength factors α and β may be varied during operation of device 10 based on the image content being presented on display 14.

It may be desirable to optimize the daltonization strength factors to balance some of the tradeoffs associated with daltonization. In particular, a greater daltonization strength may result in a more significant transformation of the color space so that confusing colors for color vision deficient users are no longer located on a "confusion line" (e.g., a line in a two-dimensional color space that designates which colors are difficult to distinguish for color vision deficient users). However, the greater the rotation of the color space, the more likely some colors will be pushed outside of the display's available color gamut, resulting in clipping for some saturated colors.

To find the appropriate daltonization strength factors that balance the tradeoff between confusing color separation and clipping, processing circuitry (e.g., processing circuitry in device 10 or processing circuitry that is separate from device 10) may be used to test different daltonization strength factors until an appropriate value is determined.

One way to evaluate a daltonization strength factor is to determine its effect on the sum of color differences of all color combinations in a color space (e.g., the color space of display 14 such as sRGB or other suitable color space). In particular, the processing circuitry may daltonize (e.g., transform) the entire color space of display 14 using a given daltonization strength factor. The processing circuitry may then determine the color difference between all possible combinations of colors in the color space. Greater color differences between color pairs leads to both less clipping (e.g., by increasing the color difference between different shades of saturated green) and greater confusing color separation (e.g., by increasing the color difference between red and green and other colors on confusion lines). Thus, processing circuitry may test different daltonization strength factors until the sum of color differences for all possible combinations of colors in the color space is maximized.

In some arrangements, it may be desirable to only test a subset of colors in the color space of display 14. For example, rather than evaluating the effect of each daltonization strength factor on all colors in the color space, the processing circuitry may evaluate the effect on a subset of representative colors in the display's color space. The subset of colors may be selected based on a radial sampling of colors in the sRGB color gamut in a perceptually uniform color space (e.g., CIELAB). This is, however, merely illustrative. If desired, the subset of colors may be selected based on user studies, based on a random selection, based on which colors are most problematic for color vision deficient users, or based on any other suitable method.

After selecting the desired subset of colors, the processing circuitry may test different daltonization strength factors on the subset colors until the sum of color differences between all possible combinations of the subset colors is maximized.

If desired, the sum may be a weighted sum. In particular, the color differences for certain color combinations may be weighted more than the color differences for other color combinations. For example, if it is more important to separate confusing colors than to avoid clipping, the color difference between red and green may be weighted more heavily than the color difference between two different shades of green.

If desired, the weighting factor for each color pair may be based on the color difference that a user with normal vision would observe for that pair. For example, the color difference between red and green for a user with normal vision may be used as the weighting factor for weighting the color difference between red and green for a user with color vision deficiency. Similarly, the color difference between two different shades of green for a user with normal vision may be used as the weighting factor for weighting the color difference between two different shades of green for a user with color vision deficiency.

This is, however, merely illustrative. If desired, weighting factors may be based on other factors (e.g., based on location, based on which type of content is being displayed on display 14, based on ambient lighting conditions, or based on any other suitable factor(s)). The processing circuitry may test different daltonization strength factors until the weighted sum is maximized in order to balance the tradeoff between clipping and separation of confusing colors.

Figure 10:
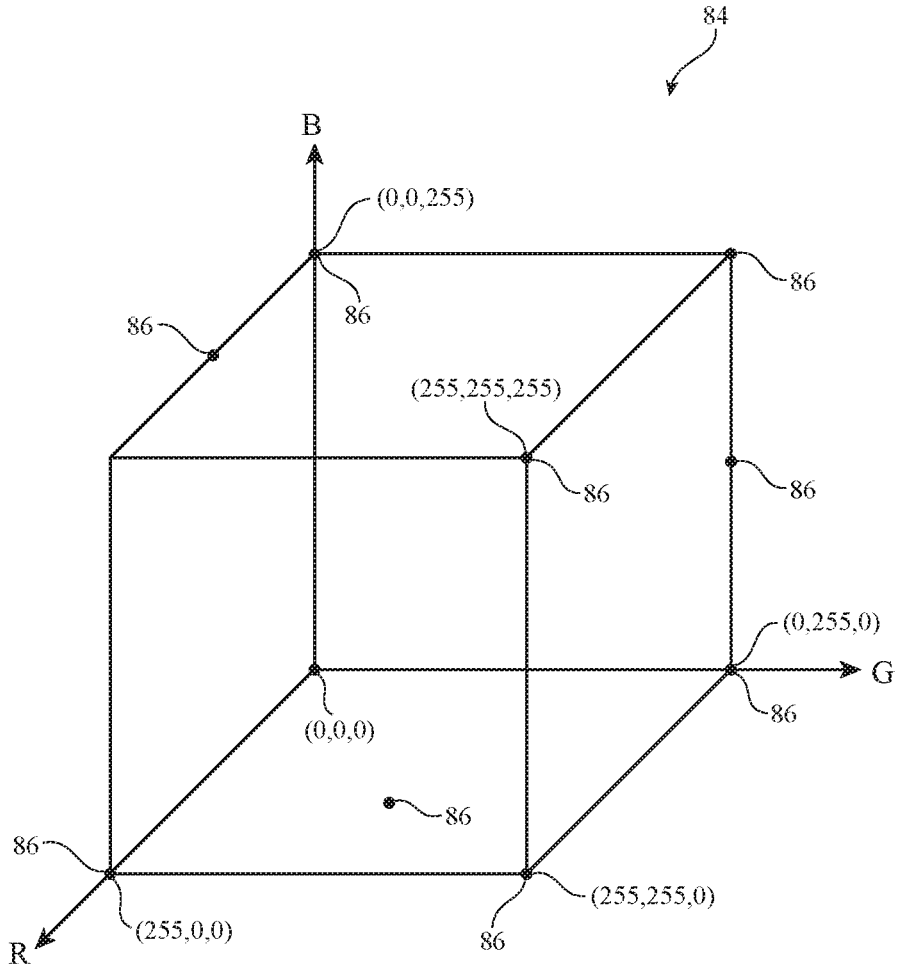
FIG. 10 is a graph illustrating how a three-dimensional look-up table may be used to map an input image to a daltonized output image in accordance with an embodiment.

If desired, the input and output values associated with the matrix operations of FIGS. 7, 8, and 9 may be stored in a look-up table such as a three-dimensional look-up table (3D LUT). FIG. 10 is a graph representing a three-dimensional look-up table of the type that may be stored in device 10. Using 3D LUT 84, control circuitry 16 may map each set of input pixel values (e.g., input RGB values) to a corresponding set of output pixel values. The output values that are assigned to the input values may be determined using a daltonization algorithm of the type described in connection with FIGS. 7, 8, and 9. For example, the algorithm of FIG. 7 may be applied to various input pixel values (represented as nodes 86 in FIG. 10) and the corresponding output pixel values (e.g., RGB values associated with output LMS values 82 of FIG. 7) may be stored in 3D LUT 84. Each 3D LUT 84 may have any suitable number of nodes (e.g., 17 nodes per color channel or any other suitable number of nodes per color channel). A node is a set of RGB values where a correction is allocated (e.g., 0, 0, 255). During operation of device 10, input pixel values that are between nodes may be daltonized by interpolating from adjacent nodes 86.

The use of a 3D LUT may allow for non-linear mapping of the color loss. For example, the daltonization strength may vary as desired across the 3D LUT (e.g., neutral colors such as (255, 255, 255) may have output pixel values that result in greater daltonization than that used for saturated colors such as (0,255,0). As another example, certain saturated colors such as green may be rotated (color-shifted) less than other saturated colors such as red to avoid clipping in the green portion of the spectrum where clipping might be more perceivable to the user.

Device 10 may store one 3D LUT per color deficiency type or may store more than one 3D LUT per color deficiency type (e.g., one deuteranope-specific 3D LUT may be used for web content and graphic art, another deuteranope-specific 3D LUT may be used for natural images, etc.). The use of multiple 3D LUTs may allow for different types of non-linear mapping. For example, one 3D LUT may treat saturated colors with one daltonization strength whereas another 3D LUT may treat the same saturated colors with a different daltonization strength. In some embodiments, a 3D LUT may be custom-built for a user based on the specific characteristics of his or her color vision deficiency.

Figure 11:
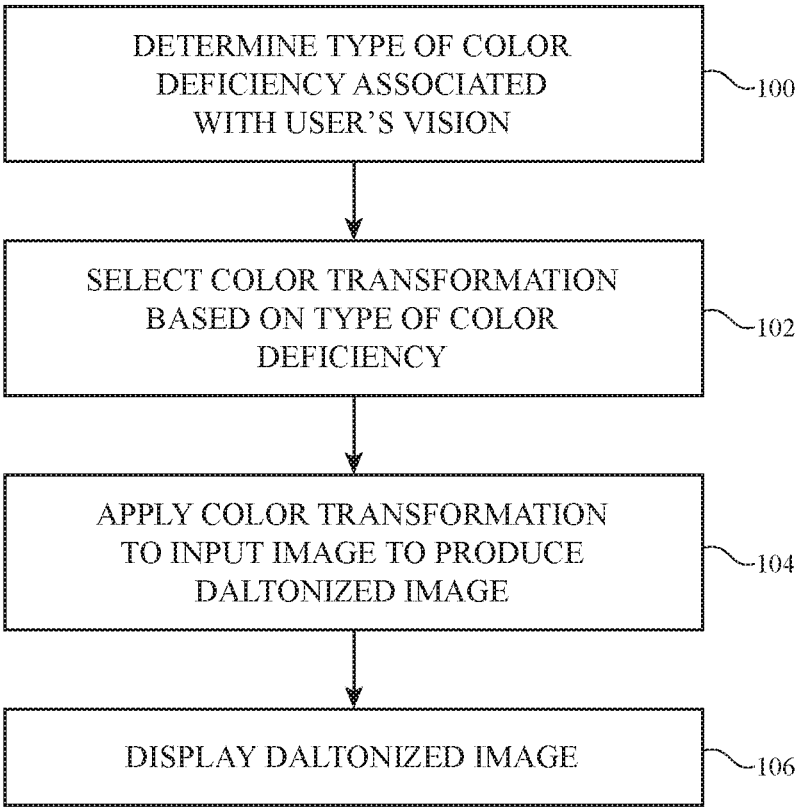
FIG. 11 is a flow chart of illustrative steps involved in displaying daltonized images for a user with color vision deficiency in accordance with an embodiment.

FIG. 11 is a flow chart of illustrative steps involved in daltonizing an image using a predetermined daltonization strength.

At step 100, control circuitry 16 may determine the type of color vision deficiency that a user has. This may be achieved by showing the user Ishihara plates, having the user manually select his or her type of color vision deficiency from an on-screen menu of options, or using other color vision tests to determine color vision deficiency type. If desired, device 10 may remember a user's type of color vision deficiency so that step 100 need not be repeated more than once. A user's type of color vision deficiency may, for example, be stored in the user's cloud storage account or profile settings so that any time the user signs in to his or her account or profile on a given device, that device can access the appropriate daltonization settings for the user.

At step 102, control circuitry 16 may select an appropriate color transformation based on the user's type of color vision deficiency. This may include, for example, selecting a 3D LUT based on the type of color vision deficiency. In this example, the 3D LUT would be fixed but could include varying daltonization strengths throughout the table. In another suitable embodiment, step 102 may include selecting the daltonization strength matrix of FIG. 7, FIG. 8, or FIG. 9, depending on the type of color vision deficiency. In this example, each matrix 78 may include fixed daltonization strength factors (e.g., $\alpha$ and $\beta$) that have been predetermined (e.g., during device calibration or manufacturing). Although the daltonization strength factors are fixed, the factors may be optimized to balance the trade-offs between color loss, impact on image quality (naturalness, contrast, etc.), and image accessibility.

At step 104, control circuitry 16 may apply the selected color transformation to the input image to produce a daltonized image. In embodiments where the color transformation is implemented with a 3D LUT, the control circuitry 16 may determine the output RGB values associated with the RGB input values using the 3D LUT. In arrangements where the color transformation is implemented using three-by-three matrices 78, control circuitry 16 may first determine the color loss associated with the input pixel values (e.g., using a method of the type described in connection with FIG. 6) and may then use one of the matrix equations of FIGS. 7, 8, and 9 to map the color loss to the functioning color channels.

At step 106, control circuitry 16 may provide the daltonized pixel values to display 14, which in turn may display the daltonized image.

Figure 12:
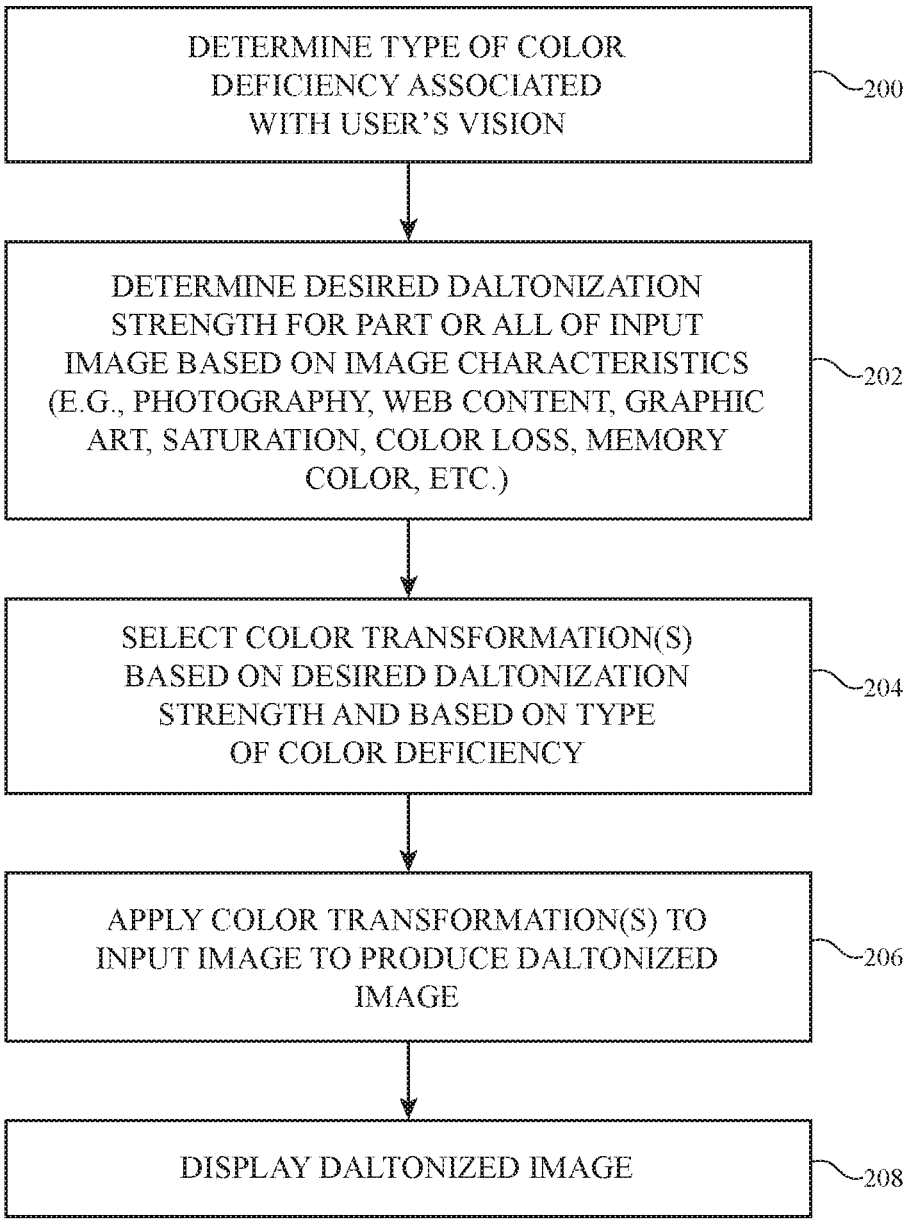
FIG. 12 is a flow chart of illustrative steps involved in displaying daltonized images with content-specific daltonization in accordance with an embodiment.

FIG. 12 is a flow chart of illustrative steps involved in daltonizing an image using content-specific daltonization strengths.

At step 200, control circuitry 16 may determine the type of color vision deficiency that a user has. This may be achieved by showing the user Ishihara plates, having the user manually select his or her type of color vision deficiency from an on-screen menu of options, or using other color vision tests to determine color vision deficiency type. If desired, device 10 may remember a user's type of color vision deficiency so that step 100 need not be repeated more than once. A user's type of color vision deficiency may, for example, be stored in the user's cloud storage account or profile settings so that any time the user signs in to his or her account or profile on a given device, that device can access the appropriate daltonization settings for the user.

At step 202, control circuitry 16 may determine a desired daltonization strength for part or all of the input image based on image characteristics associated with the input image. For example, control circuitry 16 may determine daltonization strength based on the type of content (e.g., photograph, graphic art, text information, video, web page, etc.), the application presenting the content (e.g., a photo viewing application, a web browsing application, a word processing application, an e-mail application, etc.), color characteristics of the content (e.g., saturation level, memory color, neutral color, etc.), an amount of color loss associated with a simulated color deficient version of the original image, or other suitable characteristics of the content in the image. If desired, the strength of daltonization may be adjusted based on user preferences.

At step 204, control circuitry 16 may select an appropriate color transformation based on the desired daltonization strength and based on the user's type of color vision deficiency. This may include, for example, selecting one or more 3D LUTs based on the type of color vision deficiency and the desired daltonization strength (e.g., selecting a first 3D LUT with daltonization strengths suitable for natural images and a second 3D LUT with daltonization strengths suitable for web content). In another suitable embodiment, step 204 may include selecting the daltonization strength matrix of FIG. 7, FIG. 8, or FIG. 9, depending on the type of color vision deficiency. In this example, each matrix 78 may include daltonization strength factors (e.g., $\alpha$ and $\beta$) that are set based on the desired daltonization strength (determined in step 202).

If desired, step 202 in which control circuitry 16 determines a desired daltonization strength may be omitted because control circuitry 16 may be configured to simply select an appropriate color transformation with the desired daltonization strength based on the image content. The selection of an appropriate color transformation (e.g., the selection of an appropriate 3D LUT or daltonization strength matrix 78) may implicitly include selecting a color transformation with a daltonization strength that is suitable for the image content.

At step 206, control circuitry 16 may apply the selected color transformations to the input image to produce a daltonized image. In embodiments where the color transformations are implemented with 3D LUTs, the control circuitry 16 may determine the output RGB values associated with the RGB input values using the 3D LUTs (e.g., applying one 3D LUT to natural images within the input image and another 3D LUT to web content in the input image). In arrangements where the color transformation is implemented using three-by-three matrices 78, control circuitry 16 may first determine the color loss associated with the input pixel values (e.g., using a method of the type described in connection with FIG. 6) and may then use one of the matrix equations of FIGS. 7, 8, and 9 to map the color loss to the functioning color channels. In this type of arrangement, different daltonization strength factors $\alpha$ and $\beta$ may be used for different portions of the image.

At step 208, control circuitry 16 may provide the daltonized pixel values to display 14, which in turn may display the daltonized image.

The foregoing is merely illustrative and various modifications can be made by those skilled in the art without departing from the scope and spirit of the described embodiments. The foregoing embodiments may be implemented individually or in any combination.

What is claimed is:

1. A method for displaying an image on a display in an electronic device having control circuitry, comprising:

with the control circuitry, determining a color transformation with an associated daltonization strength, wherein the daltonization strength is image-content-specific;

with the control circuitry, applying the color transformation to the image to produce a daltonized image; and with the display, displaying the daltonized image.

2. The method defined in claim 1 wherein determining the color transformation with the associated daltonization strength comprises selecting a first color transformation with a first daltonization strength for a first portion of the image and a second color transformation with a second daltonization strength for a second portion of the image, and wherein the first daltonization strength is less than the second daltonization strength.

3. The method defined in claim 2 wherein applying the color transformation to the image comprises applying the first color transformation to the first portion of the image and the second color transformation to the second portion of the image.

4. The method defined in claim 1 wherein determining the color transformation with the associated daltonization strength comprises determining the color transformation with the associated daltonization strength based on one or more image characteristics selected from the group consisting of: type of image content, application displaying the image content, saturation levels associated with the image content, and whether the image content includes a memory color.

5. The method defined in claim 1 wherein determining the color transformation with the associated daltonization strength comprises selecting a three-dimensional look-up table based on image content.

6. The method defined in claim 1 wherein determining the color transformation with the associated daltonization strength comprises selecting a first three-dimensional look-up table based on image content in a first portion of the image and a second three-dimensional look-up table based on image content in a second portion of the image.

7. The method defined in claim 1 wherein determining the color transformation with the associated daltonization strength comprises selecting a three-by-three matrix with a daltonization strength factor based on image content.

8. The method defined in claim 1 wherein determining the color transformation with the desired daltonization strength comprises selecting a first three-by-three matrix with a first daltonization strength factor based on image content in a first portion of the image and selecting a second three-by-three matrix with a second daltonization strength factor based on image content in a second portion of the image.

9. The method defined in claim 1 further comprising:

with the control circuitry, determining a type of color vision deficiency associated with a user's vision, wherein determining the color transformation comprises determining the color transformation based on the type of color vision deficiency.

10. The method defined in claim 9 wherein determining the type of color vision deficiency comprises determining the type of color deficiency based on input from the user.

11. A method for displaying an image on a display in an electronic device having control circuitry, comprising:

with the control circuitry, daltonizing a first portion of the image using a first daltonization strength;

with the control circuitry, daltonizing a second portion of the image using a second daltonization strength that is greater than the first daltonization strength; and after daltonizing the first and second portions of the image, displaying the image on the display.

12. The method defined in claim 11 wherein the first daltonization strength is based on image content in the first portion of the image and the second daltonization strength is based on image content in the second portion of the image.

13. The method defined in claim 11 wherein daltonizing the first and second portions of the image comprises daltonizing the first and second portions of the image using a three-dimensional look-up table.

14. The method defined in claim 11 wherein daltonizing the first and second portions of the image comprises daltonizing the first portion of the image using a first three-dimensional look-up table and daltonizing the second portion of the image using a second three-dimensional look-up table.

15. The method defined in claim 14 wherein the control circuitry determines whether to use the first three-dimensional look-up table or the second three-dimensional look-up table based on a type of image content being displayed.

16. The method defined in claim 15 wherein each of the first and second three-dimensional look-up tables is configured to map input colors to daltonized output colors with varying degrees of daltonization strength.

17. An electronic device, comprising:

a display that displays images;

control circuitry that controls the display; and storage that stores a three-dimensional look-up table for daltonizing the images for the display, wherein the control circuitry maps input colors to daltonized output colors with varying degrees of daltonization strength using the three-dimensional look-up table.

18. The electronic device defined in claim 17 further comprising an additional three-dimensional look-up table for daltonizing images in the storage, wherein the control circuitry determines which three-dimensional look-up table to use to daltonize the images based on content in the images.

19. The electronic device defined in claim 17 wherein the three-dimensional look-up table is one of three three-dimensional look-up tables stored in the storage, wherein each of the three three-dimensional look-up tables corresponds to a different type of color vision deficiency.

20. The electronic device defined in claim 19 wherein the control circuitry determines which type of color vision deficiency a user has and determines which of the three three-dimensional look-up tables to use based on the user's type of color vision deficiency.

* * * * *